United States Patent [19]

Dwyer et al.

[11] Patent Number: 5,040,943

[45] Date of Patent: Aug. 20, 1991

[54] FURNACE BLOWER HOUSING AND MOUNTING BRACKET

[75] Inventors: Mark K. Dwyer, Kent; Michael P. Conner, Atwater, both of Ohio

[73] Assignee: Ametek-Lamb Electric, Kent, Ohio

[21] Appl. No.: 524,510

[22] Filed: May 17, 1990

[51] Int. Cl.[5] ..... F01D 21/12

[52] U.S. Cl. ..... 415/26; 415/47; 415/119; 415/182.1; 415/206; 417/32; 417/43; 417/423.8; 431/20

[58] Field of Search ..... 415/203, 206, 26, 47, 415/182.1, 119, 146, 147, 148, 914, 212.1; 417/423.8, 423.14, 423.15, 373, 18, 32, 43; 126/299 R, 299 D; 431/19, 20, 75, 76

[56] References Cited

U.S. PATENT DOCUMENTS

| | | | |
|---|---|---|---|
| 3,650,262 | 3/1972 | Root et al. | 431/20 |
| 4,009,705 | 3/1977 | Smith | 431/20 |
| 4,477,019 | 10/1984 | Breitbach | 431/20 |
| 4,752,210 | 6/1988 | Trent | 431/20 |
| 4,951,651 | 8/1990 | Shellenberger | 431/20 |

FOREIGN PATENT DOCUMENTS

| | | | |
|---|---|---|---|
| 0013425 | 6/1956 | Netherlands | 417/423.15 |
| 1412099 | 10/1975 | United Kingdom | 431/75 |

*Primary Examiner*—Edward K. Look
*Assistant Examiner*—Christopher M. Verdier
*Attorney, Agent, or Firm*—Renner, Kenner, Greive, Bobak, Taylor & Weber

[57] ABSTRACT

An exhaust fan blower is provided for use in induced draft furnaces. An integrally molded fan housing and exhaust conduit is provided of a material impervious to the corrosive effects of exhaust gas condensates. The conduit is of a round cross section to mate with an associated flue pipe. The fan blower includes a conduit in communication with a pilot light for constantly venting the pilot light irrespective of operation of the blower. A first bore in the fan blower housing provides means for monitoring the vacuum developed therein, while another bore provides a means for thermally sensing a blocked or restricted flue condition. A flange and mounting lugs about the periphery of the fan blower housing provide a means for mounting the system to the side of a furnace panel, while sealing such mounting engagement. A motor mounting bracket for the fan blower serves as a cooling fan guard and heat sink, having a bearing contact mounting seat cast integrally to the bracket.

18 Claims, 2 Drawing Sheets

FURNACE BLOWER HOUSING AND MOUNTING BRACKET

TECHNICAL FIELD

The invention herein resides in the art of blower assemblies and, more particularly, to a blower assembly adapted for implementation with an induced draft blower for gas furnaces. Particularly, the invention relates to a blower assembly having a housing of unitary molded construction.

BACKGROUND ART

Conventional gas furnaces are known to have an efficiency on the order of 65 percent. However, such furnaces are in disfavor with society and governmental agencies because they are inconsistent with present day efforts to avert a fuel shortage and to practice conservation.

Conventional furnaces have given way to mid efficiency and high efficiency furnaces, the former having an efficiency range on the order of 80 percent, and the latter having an efficiency rating above 90 percent. Typically, efficiency of modern furnaces has been increased by aggravating the complexity of the heat exchangers, providing circuitous paths for air to flow through the heat exchangers to receive heat from the burners therebelow. In like manner, the combustion chamber of the furnace is also of a circuitous nature, greatly resticting the actual draft from the combustion chamber to the flue or associated chimney. Indeed, it has been found that blowers must be employed with the combustion chambers of high efficiency furnaces in order to induce sufficient draft to maintain the requisite combustion. In other words, a draft assist, in the form of a blower or the like, must be placed either before, after, or between heat exchangers of such furnaces to assure a proper combustion draft by either drawing or forcing air through the combustion chamber.

Presently, the housings of existing induced draft blowers have been of sheet metal construction, spot welded to achieve the desired structure and configuration. Such units are difficult to mount on the furnace panels, and are not conductive to implemetation with sophisticated sensors to achieve safe and efficient operation. Because of the sheet metal fabrication of the prior housings, they are typically rectangular in nature, having a rectangular exhaust which necessarily requires an adapter to allow the exhaust to mate with the typical round flue pipe or the like.

The corrosive nature of flue gas condensates has had adverse affects on the sheet metal blower housings of the prior art, causing the same to deteriorate in short periods of time.

Previously known induced draft blowers have also typically been characterized by an exhaust conduit entering the cavity of the blower fan in such a manner as to generate an audible pulsating sound as each of the fan vanes of the blower fan traverses an aligned wall defined by the interconnection of the conduit with the cavity. Further, known induced draft blowers typically are incapable of separately venting the furnace pilot light, provide no integral means for sensing the development of an operational vacuum, and are incapable of determining when the flue of the system is dangerously restricted.

SUMMARY OF INVENTION

In light of the foregoing, it is a first aspect of the invention to provide an induced draft blower having a housing and exhaust conduit integrally molded of plastic which is impervious to the corrosiveness of flue gases.

Another aspect of the invention is the provision of an induced draft blower in which the blower housing includes a mounting flange and lugs to facilitate mounting to a furnace panel without the need for a separate blower housing cover.

Still a further aspect of the invention is the provision of an induced draft blower in which the geometry of the opening between the exhaust conduit and the fan cavity is constantly changing.

Yet a further aspect of the invention is the provision of an induced draft blower in which the exhaust conduit has a circular opening for mating with a flue pipe.

An additional aspect of the invention is the provision of an induced draft blower wherein the fan housing includes an integral tap for a vacuum sensor.

Still an additional aspect of the invention is the provision of an induced draft blower in which a thermal sensor is adapted for communication with the fan cavity through a port in the blower housing to sense when the exhaust flue is restricted.

A further aspect of the invention is the provision of an induced draft blower in which a conduit is provided for communication with a pilot light for separately exhausting such pilot light.

Yet an additional aspect of the invention is the provision of an induced draft blower which is simple and economical to construct, while being reliable, durable, and economical in use.

The foregoing and other aspects of the invention which will become apparent as the detailed description proceeds are achieved by an exhaust fan blower for furnaces, comprising: a housing defining a cavity and being open on one end thereof and closed on an opposite end thereof; an exhaust conduit extending from said housing and communicating with said cavity; and wherein said housing and said exhaust conduit are of integral construction.

Still further aspects of the invention which will become apparent herein are attained by a fan blower assembly for furnace exhausts, comprising: a housing defining a cavity; a fan received within said cavity; an exhaust conduit in communication with said cavity; and a first bore passing through said housing, said first bore adapted to receive a thermal sensor for sensing air passing from said cavity through said bore.

DESCRIPTION OF DRAWINGS

For a complete understanding of the objects, techniques, and structure of the invention, reference should be made to the following detailed description and accompanying drawings wherein.

BEST MODE FOR CARRYING OUT THE INVENTION

Figure 1:
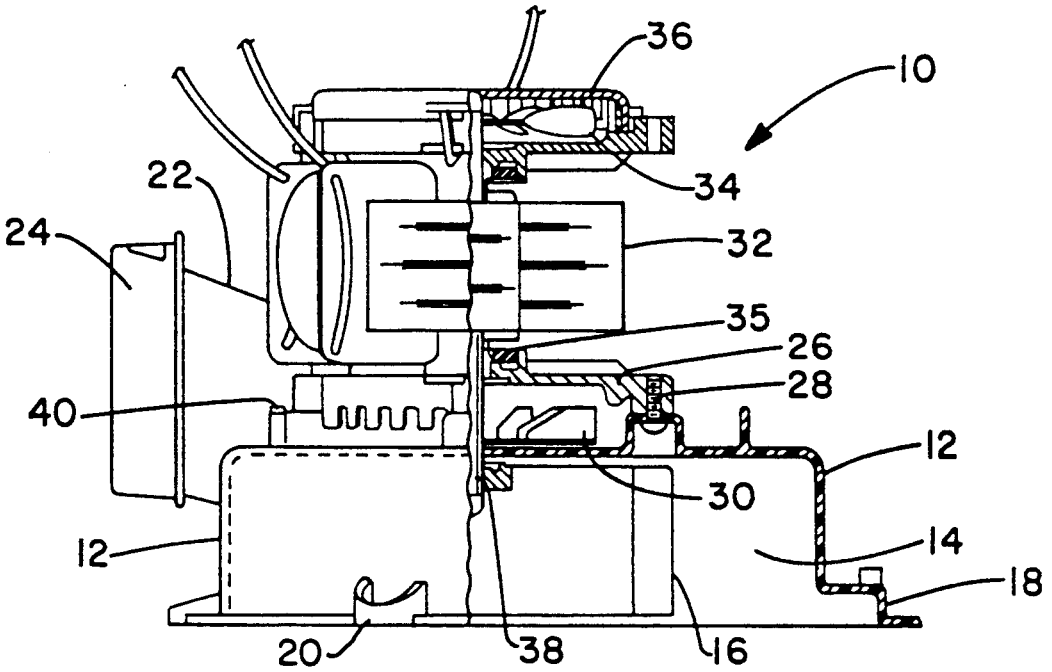
FIG. 1 is a partial sectional view of a fan blower assembly according to the invention.
Figure 2:
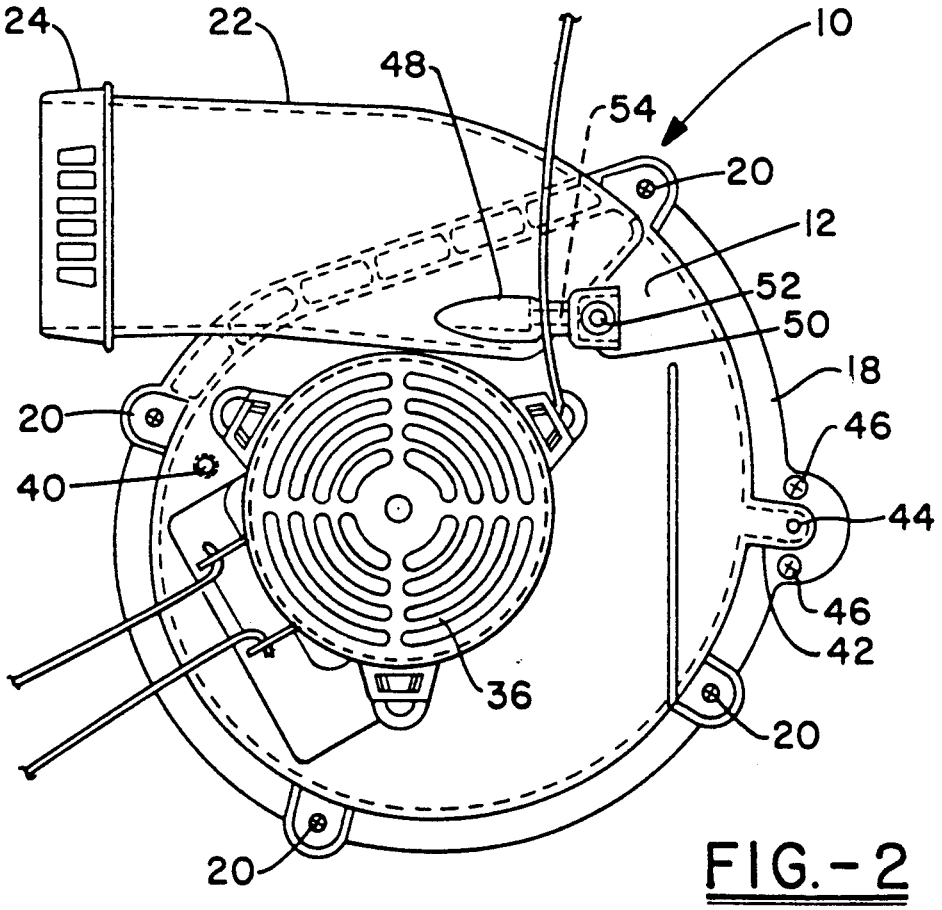
FIG.2 is a top plan view of the fan blower assembly of FIG.1.

Referring now to the drawings and more particularly FIGS. 1 and 2, it can be seen that a fan blower assembly according to the invention is designated generally by the numeral 10. The assembly 10 comprises a housing 12, generally closed at a top end thereof and open at the bottom, the housing 12 further defining a cavity 14 for receiving a blower fan 16 therein. As will be appreciated by those skilled in the art, the blower fan 16 is of the type having vanes parallel to the axis of rotation and, indeed, lying within a plane receiving the axis of rotation. In a preferred embodiment of the invention, a mounting flange 18 encompasses the open end of the generally cylindrical housing 12. Lugs 20 are positioned about the flange 18 for purposes of receiving sheet metal screws or the like for securing the fan blower assembly 10 over an opening cut into a furnace panel. The mounting flange 18 serves as a gasket to seal against the furnace panel such that the cavity 14 and blower fan 16 can communicate with the combustion chamber of the associated furnace.

The assembly 10 also includes an exhaust conduit or horn 22 interconnecting with the cavity 14 and extending to a circular mating flange 24 at the end thereof. It will be appreciated that the circular mating flange 24 is specifically provided to receive and mate with a standard flue pipe to exhaust the furnace to a chimney or otherwise outside the building receiving the furnace. It will also be appreciated that the housing 12, exhaust conduit 22, and mating flange 24 comprise an integral unit, molded of appropriate material which is impervious to the effects of flue gases, a preferred such material being polyphenylene sulphide. Such a material withstands not only the corrosiveness of such flue gas condensates, but also the excessive temperatures thereof, reaching on the order of 500° F.

A motor bracket 26, preferably of metallic construction is interconnected by means of a plurality of screws 28 to lugs extending from the top surface of the housing 12. The metallic motor bracket 26 is provided with extended surface area, for the purposes of serving as a heat sink for the motor 32 mounted thereto. To further provide for cooling of the motor 32, a cooling fan 30 is received within the motor bracket 26, which also serves as a fan guard, and beneath the motor 32, to draw in external air over the motor. Such cooling is further facilitated by means of the cooling fan 34 placed about the motor 32 and beneath a fan cover 36. Accordingly, the motor 32 is preferably maintained between a pair of cooling fans 30, 34, drawing ambient air thereacross. The cooling of the motor bearings is further facilitated by the bearing seat 35 which is integrally cast with the motor bracket 26.

In the preferred embodiment of the invention, a common shaft 38 receives the blower fan 16, cooling fans 30, 34, and the interposed motor 32. Of course, appropriate bearings and the like are provided upon the shaft 38 to facilitate the requisite rotation of the coaxial elements 16, 30, 32, 34. It will be noted from FIGS. 1 and 2 that the shaft 38 and associated elements are not coaxial with the generally cylindrical housing 12, but that the motor 32 and fan 16 are set off to a backside of the housing 12, allowing an enlarged and unrestricted front portion of the cavity 14 to feed into the conduit 22.

A tap or bore 40 passes from outside the housing 12 into the cavity 14. The tap 40, maintained in juxtaposition to the blower fan 16, is adapted to receive a vacuum meter or other sensor which may be connected thereto for purposes of monitoring the effectiveness of the operation of the assembly 10. In the event that insufficient vacuum is created by the assembly 10, as sensed by the sensor received at the tap 40, an associated control module can cause the furnace to shut down and terminate operation.

Extending from an outer wall of the housing 12 and above the flange 18 is a raised tab 42 having a bore 44 passing therethrough and into the cavity 14 of the housing 12. It will be appreciated that the bore 44 comprises a pair of orthogonal legs, a first leg extending radially into the cavity 14 and a second leg extending axially to the ambient. A pair of screw lugs 46, one on either side of the external end of the bore 44, are adapted to receive a thermal sensor. The thermal sensor is positioned over the bore 44 to sense the temperature of the gases emitted from the cavity 14. It will be appreciated by those skilled in the art that in normal operation, air will be drawn from outside the housing 12, through the bore 44, into the cavity 14, and then exhausted through the exhaust conduit 22. However, if the flue to which the exhaust conduit 22 is connected is blocked or otherwise restricted, the blower fan 16 may create sufficient back pressure within the cavity 14 as to blow the hot combustion air out of the bore 44, rather than drawing the cooler ambient air into the cavity 14 through the bore 44. The hot combustion gases which impinge upon the thermal sensor positioned over the bore 44 generate an appropriate electrical signal indicating a blocked or restricted flue condition, such signal then being used to inhibit operation of the furnace until the condition is corrected. It will, of course, be understood by those skilled in the art that the size and position of the bore 44 with respect to the cavity 14 and fan 16 will determine the degree of flue restriction which will result in a back flow of heated exhaust gases from the cavity 14 and out of the bore 44.

The generally cylindrical shaped exhaust conduit 22 has an enlarged bulbous portion 48 near the inlet thereof where the conduit 22 meets with the cavity 14. A lug 50 is positioned at the end of the bulbous portion 48, having a hole 52 passing therethrough for receiving a set screw or the like. The hole 52 communicates orthogonally with a bore 54 which passes through the bulbous portion 48 and opening into the interior of the conduit 22. The structure 48–54 provides means for venting the furnace pilot when the furnace burners are not ignited and the blower 16 is not operating.

Figure 3:
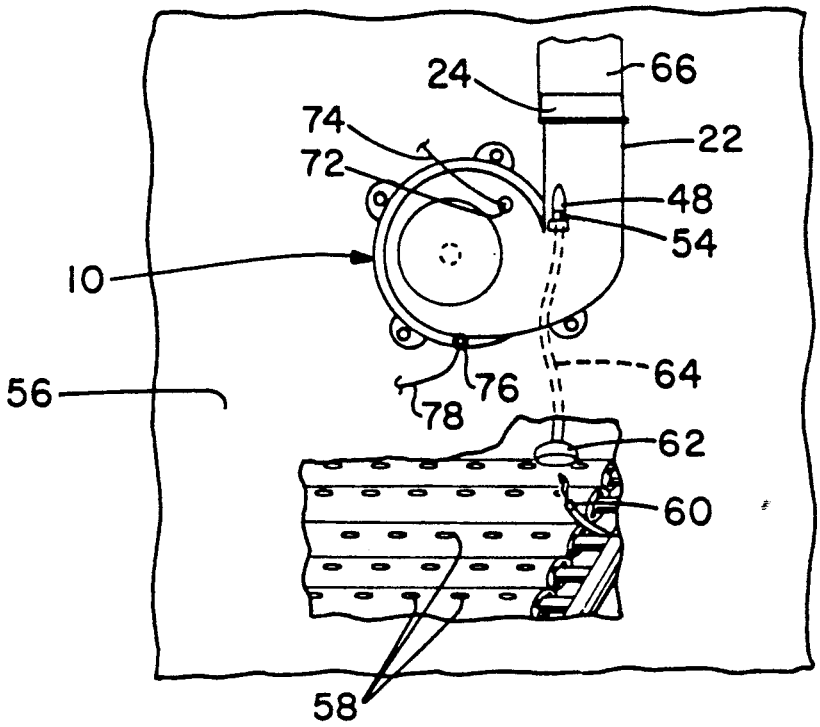
FIG. 3 is a partial sectional view of a furance panel shown implementing the fan blower assembly of the invention.

In FIG. 3, a panel 56 of a furnace is shown in cut away section to expose a plurality of furnace burners 58 therein, the same having associated therewith a pilot light source 60. It will be appreciated that when a valve meters gas to the burners 58, the pilot 60 ignites the same. However, when no such gas is provided, in many furnaces the pilot 60 remains ignited. It is therefore necessary to provide a means for venting or exhausting the standing pilot light 60. To this end, a hood 62 is fixedly positioned over the pilot light 60 and communicates through a conduit 64 to the bore 54 in the bulbous portion 48 of the exhaust conduit 22. The conduit 64 is retained in the bore 54 by means of a set screw or the like received within the hole 52. Accordingly, the open end of the conduit 64 communicates directly with the exhaust conduit 22. As shown in FIG. 3, the exhaust conduit 22 is appropriately connected to a vent or exhaust pipe 66, the same being received by the mating flange 24. With the structure just provided, the pilot 16 is constantly vented, irrespective of operation of the burners 58 and/or fan 16.

As mentioned earlier, the size and position of the bore 44 with respect to the cavity 14 determines the degree of flue restriction which will result in a positive pressure at the bore 44 to effect a back flow of heated gases therefrom. In like manner, the size and position of the bore 54 which respect to the cavity 14 must be established to accommodate flue restrictions and the effect, purpose, and operation of the bore 44. To that end, the bore 54 is sized and positioned to evidence a vacuum of negative pressure thereat beyond the point of flue restrictions at which the bore 44 evidences a positive pressure. Accordingly, the standing pilot 60 is continously vented over the entire operational range of the furnaces. In a preferred embodiment of the invention, the bore 54 evidences a negative pressure up to 80% flue restriction, while which the bore 44 evidences a negative pressure up to 80% flue restriction.

Figure 4:
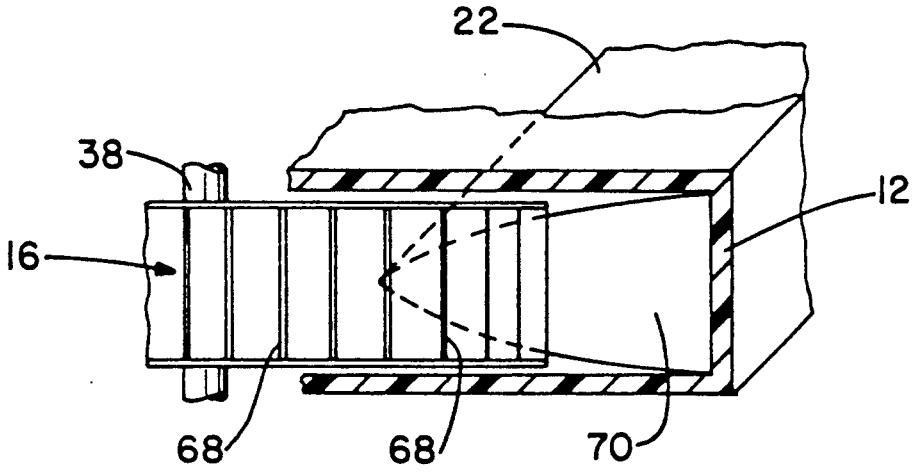
FIG. 4 is a partial sectional view of the blower fan of the invention in operative positional relationship to the opening of the exhaust conduit into the fan cavity.

As presented earlier, and as shown in FIG. 4, the fan 16 is characterized by a plurality of vanes 68 which are parallel to the rotational axis of the shaft 38. In the prior art, a rectangular opening interconnected the cavity receiving the fan with an exhaust conduit. The rectangular opening necessarily provided an edge in vertical alignment with the edges of the vanes of the fan. Accordingly, as the fan rotated and the vanes passed the aligned opening edge, a pulsating noise was generated, such being objectionable to consumers. According to the instant invention, and as shown in FIG. 4, the opening 70 from the cavity 14 to the exhaust 22 is of an arcuate nature, having a constantly and gradually changing cross sectional area with no abrupt edges positioned near the vanes 68. In the preferred embodiment shown, the opening 70 is semi-elliptical, tapering to a closed end, thereby eliminating the pulsating noises associated with the prior art. As the fan vanes 68 pass the opening 70, at any particular point in time adjacent blades will be at different opening geometries so that any noise emitted by the passing of the fan across the opening will be of a homogenous rather than a pulsing nature.

Referring again to FIG. 3, it can be seen that the assembly 10 includes a vacuum sensor 72 received by the tap 40, the same being interconnected by a conduit or electrical conductor 74 to an appropriate control module. As presented earlier, the vacuum sensor 72 presents an output signal, either of electrical or pneumatic nature, indicating that the fan 16 is operational and generating an adequate vacuum. In like manner, a thermal sensor 76, such as a thermocouple or the like, is secured with screw lugs 46 to be maintained in juxtaposition to the bore 44, sensing a back pressure situation when heated exhaust gas is emitted from the bore 44 and onto the thermal sensor 76. The corresponding signal, indicating a blocked or restricted flue situation, is then emitted across the conductor 78 to an appropriate control module to shut down the furnace until the situation is corrected.

Thus it can be seen that the objects of the invention have been satisfied by the structure presented above. While in accordance with the patent statutes only the best mode and preferred embodiment of the invention has been presented and described in detail, it is to be understood that the invention is not limited thereto or thereby. Accordingly, for an appreciation of the true scope and breadth of the invention reference should be made to the following claims.

What is claimed is:

1. An exhaust fan blower for furnaces, comprising:

a housing defining a cavity, said cavity receiving a fan therein, and said housing being open at one end thereof and closed at an opposite end thereof;

an exhaust conduit extending from said housing and communicating with said cavity, said conduit having a first end connected to said housing, and a second end unconnected to said housing and having a circular cross section; and wherein said housing and said exhaust conduit are of integral construction, and wherein said housing has first and second bores passing therethrough, said first bore receiving a vacuum sensor in juxtaposition to said fan, and said second bore providing a passage for air from outside said housing and into said cavity when said exhaust conduit is unrestricted, and providing a passage for air from said cavity to an outside of said housing when said exhaust conduit is restricted.

2. The exhaust fan blower for furnaces according to claim 1, further comprising means for securing a pilot light exhaust passage in communication with said exhaust conduit.

3. The exhaust fan blower for furnaces according to claim 2, wherein said pilot light exhaust comprises a tube having a first end adapted to be positioned in exhaust receiving communication with a pilot light, and a second end secured within said exhaust conduit.

4. The exhaust fan blower for furnaces according to claim 3, wherein said second end is secured in a third bore.

5. The exhaust fan blower for furnaces according to claim 1, wherein said cavity receives a fan rotatable upon a shaft, said fan having vanes parallel to said shaft.

6. The exhaust fan blower for furnaces according to claim 5, wherein said exhaust conduit mates with said housing to communicate with said cavity at an opening, said opening being absent a vertical edge in juxtaposition to said fan, and having a geometry of uniformly changing dimensions.

7. The exhaust fan blower for furnaces according to claim 6, wherein said housing has a flange about said open end thereof and adapted for secured engagement to a furnace panel.

8. A fan blower assembly for furnace exhausts, comprising:

a housing defining a cavity;

a fan received within said cavity;

an exhaust conduit in communication with said cavity;

a first bore passing through said housing, said first bore adapted to receive a thermal sensor for sensing air passing from said cavity through said bore; and wherein said fan has vanes parallel to a shaft upon which said fan rotates, said exhaust conduit entering said cavity at an opening having dimensions taken parallel to said vanes which gradually increase from one side of said opening to another side thereof.

9. The fan blower assembly according to claim 8, wherein said exhaust conduit receives a tube adapted for communication with a pilot light.

10. The fan blower assembly according to claim 9, wherein said tube is received within a second bore passing through said housing, said first bore evidencing a positive pressure thereat at a lower level of restriction of said exhaust conduit than said second bore.

11. The fan blower assembly according to claim 9, wherein said housing has a flange extending about an open end thereof, said flange providing sealing means against a furnace panel.

12. The fan blower assembly according to claim 8, wherein said housing and exhaust conduit are of integral construction.

13. The fan blower assembly according to claim 12, wherein said exhaust conduit has a circular open end adapted for receiving an exhaust flue pipe of circular cross section.

14. The fan blower assembly according to claim 8, wherein said housing has a second bore passing therethrough for receiving a vacuum sensor.

15. The fan blower assembly according to claim 8, wherein said opening is arcuate.

16. The fan blower assembly according to claim 8, further comprising a bracket for receiving a motor for driving said fan, said bracket having an integrally formed bearing seat receiving said shaft, said motor bracket further comprising a heat sink.

17. An exhaust fan blower for furnaces, comprising:

a housing defining a cavity, said cavity receiving a fan rotatable upon a shaft, said fan having vanes parallel to said shaft, and said housing being open at one end thereof and closed at an opposite end thereof;

an exhaust conduit extending from said housing and communicating with said cavity; and wherein said housing and said exhaust conduit are of integral construction, and said exhaust conduit mates with said housing to communicate with said cavity at an opening, said opening being absent a vertical edge in juxtaposition to said fan, and having a geometry of uniformly changing dimensions.

18. The exhaust fan blower for furnaces according to claim 17, wherein said housing has a flange about said open end thereof and adapted for secured engagement to a furnace panel.

* * * * *